United States Patent [19]

Glanz

[11] Patent Number: 4,586,061

[45] Date of Patent: Apr. 29, 1986

[54] THERMALLY-RESPONSIVE RECORD MATERIAL

[75] Inventor: Kenneth D. Glanz, Appleton, Wis.

[73] Assignee: Appleton Papers Inc., Appleton, Wis.

[21] Appl. No.: 733,016

[22] Filed: May 13, 1985

Related U.S. Application Data

[63] Continuation-in-part of Ser. No. 670,106, Nov. 9, 1984, abandoned.

[51] Int. Cl.[4] ..... B41M 5/18

[52] U.S. Cl. ..... 346/216; 346/217; 346/225; 427/150; 427/151

[58] Field of Search ..... 346/216, 217, 225, 214, 346/220, 221, 223; 427/150, 151

[56] References Cited

U.S. PATENT DOCUMENTS

| | | | |
|---|---|---|---|
| 4,408,781 | 10/1983 | Watanabe | 428/327 |
| 4,467,339 | 8/1984 | Asami et al. | 346/214 |

FOREIGN PATENT DOCUMENTS

| | | | |
|---|---|---|---|
| 0155059 | 12/1979 | Japan | 346/217 |
| 0034996 | 2/1982 | Japan | 346/217 |
| 0043896 | 3/1982 | Japan | 346/225 |
| 0150598 | 9/1982 | Japan | 346/216 |
| 0151394 | 9/1982 | Japan | 346/216 |

*Primary Examiner*—Bruce H. Hess

*Attorney, Agent, or Firm*—E. Frank McKinney; Paul S. Phillips, Jr.

[57] ABSTRACT

A thermally-sensitive color-forming composition is disclosed which comprises chromogenic material and certain acidic developer material. Record material comprising this color-forming composition exhibits improved color-forming efficiency and/or image density.

7 Claims, No Drawings

THERMALLY-RESPONSIVE RECORD MATERIAL

This application is a continuation-in-part of copending application Ser. No. 670,106, filed Nov. 9, 1984, now abandoned.

This invention relates to thermally-responsive record material. It more particularly relates to such record material in the form of sheets coated with color-forming systems comprising chromogenic material and acidic color developer material. This invention particularly concerns a thermally-responsive record material with improved color-forming sensitivity and/or image density.

Thermally-responsive record material systems are well known in the art and are described in many patents, for example U.S. Pat. Nos. 3,539,375; 3,674,535; 3,746,675; 4,151,748; 4,181,771; and 4,246,318 which are hereby incorporated by reference. In these systems, basic chromogenic material and acidic color developer material are contained in a coating on a substrate which, when heated to a suitable temperature, melts or softens to permit said materials to react, thereby producing a colored mark.

In the field of thermally-responsive record material, thermal sensitivity (response) is defined as the temperature at which a thermally-responsive record material produces a colored image of satisfactory intensity (density). The desired temperature of imaging varies with the type of application of the thermally-responsive product and the equipment in which the imaging is to be performed. The ability to shift the temperature at which a satisfactorily intense thermal image is produced for any given combination of chromogenic material and developer material is a much sought after and very valuable feature.

Also in the field of thermally-responsive record material, the ability to increase the efficiency of the thermal image formation process has decided advantages. Principal among these are the ability to obtain the same image intensity with a lower amount of reactants or, alternatively, to obtain a more intense image with the same amount of reactants.

One of the uses for thermally-responsive record material which is enjoying increasing importance is facsimile reproduction. Alternative terms for facsimile are telecopying and remote copying. In the facsimile system, images transmitted electronically are reproduced as hard copy. The trend in facsimile equipment is towards shorter transmission times and higher resolution of the facsimile-produced image. This trend requires thermally-responsive record material with increased sensitivity.

Increases in the sensitivity of thermally-responsive record material have been achieved through the incorporation of a phenylhydroxynaphthoate compound or a hydroxyanilide compound in the color-forming composition along with the chromogenic material and developer material as disclosed in U.S. Pat. No. 4,470,057 or co-pending application Ser. No. 607,558, respectively, by Kenneth D. Glanz, the inventor herein.

Another means of achieving increased sensitivity is presented in U.S. Pat. No. 4,436,783 which discloses thermosensitive recording material containing as the color developer a fused mixture comprising a bisphenol compound and another phenolic compound, wherein the fused mixture has a melting point lower than that of the bisphenol compoun.

U.S. Pat. No. 3,539,375 discloses, as developer material in a thermo-responsive record sheet, 4,4'-isopropylidene-bis(2-tertiarybutylphenol) and 4,4'-sec.butylidene bis(2-methylphenol).

Applicant has discovered, unexpectedly, that a thermally-responsive record material employing a color-forming composition comprising chromogenic material and, as a color developer, a bisphenol compound of the structure

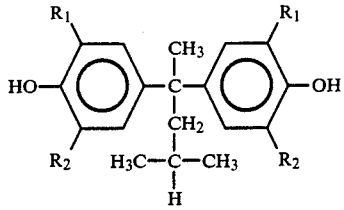

wherein $R_1$ is a 1–4 carbon alkyl radical, or a 1–2 carbon alkoxy radical, and $R_2$ is hydrogen, or a 1–4 carbon alkyl radical, produces enhanced thermal sensitivity and/or enhanced image density and/or improved background coloration characteristics.

It is an object of the present invention to provide a thermally-responsive recording material having improved thermal sensitivity.

It is also an object of the present invention to provide a thermally-responsive recording material having an enhanced image intensity.

It is likewise an object of the present invention to provide a thermally-responsive record material comprising a support member bearing a thermally-sensitive color-forming composition comprising chromogenic material and, as developer material, a bisphenol compound of the structure

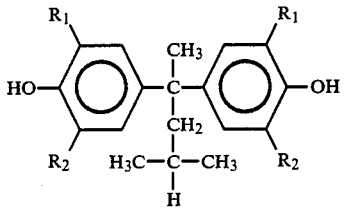

wherein $R_1$ and $R_2$ are as previously defined, in contiguous relationship, whereby the melting, softening, or sublimation of either material produces a change in color by reaction between the two, and a suitable binder therefor.

In accordance with the present invention, it has been found that these and other objectives may be attained by employing a thermally-sensitive color-forming composition comprising chromogenic material, acidic developer material comprising a bisphenol compound of the structure

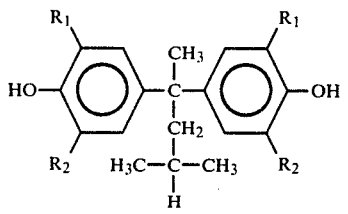

wherein $R_1$ is a 1–4 carbon alkyl radical, or a 1–2 carbon alkoxy radical and $R_2$ is hydrogen, or a 1–4 carbon alkyl radical, and binder material. The surprising feature of this composition is that the composition possesses improved thermal sensitivity and/or increased efficiency of thermal image formation.

More specifically, in accordance with the present invention, it has been found that these and other objectives may be attained by employing a thermally-sensitive color-forming composition comprising chromogenic material, acidic developer material comprising a bisphenol compound of the structure

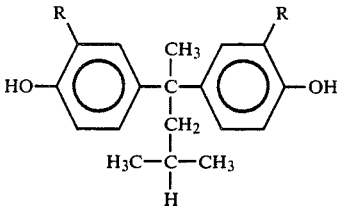

wherein R is a 1–4 carbon alkyl radical, and binder material.

The color-forming composition (or system) of the record material of this invention comprises chromogenic material in a substantially colorless state and acidic developer material. The color-forming system relies upon melting, softening, or subliming of one or more of the components to achieve reactive, color-producing contact.

The record material includes a substrate or support material which is generally in sheet form. For purposes of this invention, sheets also mean webs, ribbons, tapes, belts, films, cards and the like. Sheets denote articles having two large surface dimensions and a comparatively small thickness dimension. The substrate or support material can be opaque, transparent or translucent and could, itself, be colored or not. The material can be fibrous including, for example, paper and filamentous synthetic materials. It can be a film including, for example, cellophane and synthetic polymeric sheets cast, extruded, or otherwise formed. The gist of this invention resides in the color-forming composition coated on the substrate. The kind or type of substrate material is not critical.

Although not required to practice and demonstrate the beneficial properties of the claimed invention, the inclusion of certain sensitizing materials in the color-forming system provides a further improvement in properties, especially background stability. Materials such as phenyl-1-hydroxy-2-naphthoate, stearamide and p-hydroxyoctadecananilide are useful as such sensitizing materials.

The components of the color-forming system are in a contiguous relationship, substantially homogeneously distributed throughout the color-forming system, preferably in the form of a coated layer deposited on the substrate. In manufacturing the record material, a coating composition is prepared which includes a fine dispersion of the components of the color-forming system, polymeric binder material, surface active agents and other additives in an aqueous coating medium. The composition can additionally contain inert pigments, such as clay, talc, aluminum hydroxide, calcined kaolin clay and calcium carbonate; synthetic pigments, such as urea-formaldehyde resin pigments; natural waxes such as carnauba wax; synthetic waxes; lubricants such as zinc stearate; wetting agents and defoamers.

The color-forming system components are substantially insoluble in the dispersion vehicle (preferably water) and are ground to an individual average particle size of between about 1 micron to about 10 microns, preferably about 1 to about 3 microns. The polymeric binder material is substantially vehicle soluble, although latexes are also eligible in some instances. Preferred water-soluble binders include polyvinyl alcohol, hydroxy ethylcellulose, methylcellulose, hydroxypropylmethylcellulose, starch, modified starches, gelatin and the like. Eligible latex materials include polyacrylates, polyvinylacetates, polystyrene, and the like. The polymeric binder is used to protect the coated materials from brushing and handling forces occasioned by storage and use of the thermal sheets. Binder should be present in an amount to afford such protection and in an amount less than will interfere with achieving reactive contact between color-forming reactive materials.

Coating weights can effectively be about 3 to about 9 grams per square meter (gsm) and preferably about 5 to about 6 gsm. The practical amount of color-forming materials is controlled by economic considerations, functional parameters and desired handling characteristics of the coated sheets.

Eligible chromogenic compounds, such as the phthalide, leucauramine and fluoran compounds, for use in the color-forming system, are well known color-forming compounds. Examples of the compounds include Crystal Violet Lactone [3,3-bis(4-dimethylaminophenyl)-6-dimethylaminophthalide (U.S. Pat. No. Re. 23,024)]; phenyl-, indol-, pyrrol-, and carbazol-substituted phthalides (for example, as disclosed in U.S. Pat. Nos. 3,491,111; 3,491,112; 3,491,116; and 3,509,174); nitro-, amino-, amido-, sulfon amido-, aminobenzylidene-, halo-, and anilino-substituted fluorans (for example, as disclosed in U.S. Pat. Nos. 3,624,107; 3,627,787; 3,641,011; 3,642,828; and 3,681,390); spirodipyrans (U.S. Pat. No. 3,971,808), and pyridine andpyrazine compounds (for example, as disclosed in U.S. Pat. Nos. 3,775,424 and 3,853,869). Other specifically eligible chromogenic compounds, not limiting the invention in any way, are: 3-diethylamino-6-methyl-7-anilino-fluoran (U.S. Pat. No. 3,681,390); 3-diethylamino-6-methyl-7-(2',4'-dimethylanilino)fluoran (U.S. Pat. No. 4,330,473); 7-(1-ethyl-2-methylindol-3-yl)-7-(4-diethylamino-2-ethoxyphenyl)-5,7-dihydrofuro[3,4-b]pyridin-5-one (U.S. Pat. No. 4,246,318); 3-diethylamino-7-(2-chloroanilino)fluoran (U.S. Pat. No. 3,920,510); 3-(N-methylcyclohexylamino)-6-methyl-7-anilinofluoran (U.S.Pat. No. 3,959,571); 7-(1-octyl-2-methylindol-3-yl)-7-(4-diethylamino-2-ethoxyphenyl)-5,7-dihydrofuro[3,4-b]pyridin-5-one; 3-diethylamino-7,8-benzofluoran; 3,3-bis(1-ethyl-2-methylindol-3-yl)phthalide; 3-diethylamino-7-anilinofluoran; 3-diethylamino-7-benzylaminofluoran; 3'-phenyl-7-dibenzylamino-2,2'-spiro-di[2H-1-benzopyran]; 3-(2-hydroxy-4-diethylaminophenyl)-3-(2,4-dimethoxy-5-anilinophenyl)phthalide; 3-(2-hydroxy-4-diethylaminophenyl)-3-(2,4-dimethoxy-5-(4-chloroanilino)phenyl)phthalide; and mixtures of any two or more of the above.

The following examples are given to illustrate some of the features of the present invention and should not be considered as limiting. In these examples all parts are by weight, all solutions are in water and all measurements are in the metric system, unless otherwise stated.

The developer materials of the present invention can be made by procedures described the prior art, for example U.S. Pat. Nos. 2,775,620 and 2,917,550.

In all examples illustrating the present invention a dispersion of a particular system component was prepared by milling the component in an aqueous solution of the binder until a particle size of between about 1 micron and 10 microns was achieved. The milling was accomplished in an attritor, small media mill, or other suitable dispersing device. The desired average particle size was about 1–3 microns in each dispersion.

In these examples separate dispersions comprising the chromogenic compound (Component A), the acidic developer material (Component B), and the sensitizer materials (Components C, D and E) were prepared.

| Material | Parts |
|---|---|
| Components A-1 through A-3 | |
| Chromogenic compound | 39.10 |
| Binder, 20% polyvinyl alcohol in water | 28.12 |
| Water | 45.00 |
| Defoamer & dispersing agent* | 0.28 |
| Surfynol 104, 5% solution in isopropyl alcohol | 12.00 |
| Components A-4 through A-6 | |
| Chromogenic compound | 13.60 |
| Binder, 10% polyvinyl alcohol in water | 24.00 |
| Water | 42.35 |
| Defoamer & dispersing agent* | 0.05 |
| Component A-7 | |
| Chromogenic compound | 13.60 |
| Binder, 10% polyvinyl alcohol in water | 24.00 |
| Water | 62.35 |
| Defoamer & dispersing agent* | 0.05 |
| Components B-1 through B-5 and B-8 and B-9 | |
| Acidic developer material | 13.60 |
| Binder, 10% polyvinyl alcohol in water | 24.00 |
| Water | 42.35 |
| Defoamer & dispersing agent* | 0.05 |
| Components B-6 and B-7 | |
| Acidic developer material | 13.60 |
| Binder, 10% polyvinyl alcohol in water | 24.00 |
| Water | 62.35 |
| Defoamer & dispersing agent* | 0.05 |
| Component C | |
| Phenyl-1-hydroxy-2-naphthoate | 13.60 |
| Binder, 10% polyvinyl alcohol in water | 24.00 |
| Water | 42.35 |
| Defoamer & dispersing agent* | 0.05 |
| Component D | |
| p-hydroxyoctadecananilide | 6.80 |
| Binder, 10% polyvinylalcohol in water | 24.00 |
| Water | 42.35 |
| Defoamer & dispersing agent* | 0.05 |
| Component E | |
| Stearamide, 20% dispersion in water | |

*Equal parts of the defoamer Nopko NDW (sulfonated caster oil produced by Nopko Chemical Company) and the dispersing agent Surfynol 104 (a di-tertiary acetylene glycol surface active agent produced by Air Products and Chemicals Inc.) were employed.

The chromogenic compounds employed in the examples are listed in Table 1.

TABLE 1

| Chromogenic Compound | Designation of Dispersion Comprising said Chromogenic Compound |
|---|---|
| 3-diethylamino-6-methyl-7-anilinofluoran | A-1 |
| 7-(1-ethyl-2-methylindol-3-yl)-7-(4-diethylamino-2-ethoxyphenyl)-5,7-dihydrofuro[3,4-b]pyridine-5-one | A-2 |
| 3-diethylamino-7-(2,4-dimethylanilino)fluoran | A-3 |
| 3-(2-hydroxy-4-diethylaminophenyl)-3-(2,4-dimethoxy-5-anilinophenyl)-phthalide | A-4 |
| 3-(2-hydroxy-4-diethylaminophenyl)-3-(2,4-dimethoxy-5-(4-chloroanilino)-phenyl)phthalide | A-5 |
| 3-dibutylamino-7-(2-chloroanilino)-fluoran | A-6 |
| 3'-phenyl-7-dibenzylamino-2,2'-spiro-di[2H-1-benzopyran] | A-7 |

The acidic developer materials employed in the examples are listed in Table 2.

TABLE 2

| Acidic Developer Compound | Designation of Dispersion Comprising said Developer Compound |
|---|---|
| 4,4'-isopropylidenediphenol | B-1 |
| 2,2-bis(4-hydroxy-3-methylphenyl)-4-methylpentane | B-2 & B-6 |
| 2,2-bis(4-hydroxy-3-tert.butylphenyl)-4-methylpentane | B-3 & B-7 |
| 4,4'-sec.butylidene-bis(2-methylphenol) | B-4 |
| 4,4'-isopropylidene-bis(2-tert.butylphenol) | B-5 |
| 2,2-bis(4-hydroxy-3-isopropylphenyl)-4-methylpentane | B-8 |
| 2,2-bis(4-hydroxyphenyl)-4-methylpentane | B-9 |

Mixtures of dispersion A and B, mixtures of dispersions A, B and C, mixtures of dispersions A, B and D and mixtures of dispersions A, B and E were made. In all cases the following materials were added to the resulting mixtures:

1. A 68% kaolin clay slurry in water (designated hereinbelow as "clay");
2. A 10% solution of polyvinyl alcohol in water (designated hereinbelow as "PVA");
3. Water In some cases one or more of the following materials was added to the resulting mixture:

1. Zinc stearate, 21% dispersion;
2. Urea-formaldehyde resin pigment;
3. Micronized silica.

In Table 3 are listed each of these mixtures, including the components added and the parts by weight of each.

Each mixture of Table 3 was applied to paper and dried, yielding a dry coat weight of about 5.2 to about 5.9 gsm.

TABLE 3

| Example | | Components | Parts |
|---|---|---|---|
| Control | 1-1 | Dispersion A-1 | 0.5 |
| | | Dispersion B-1 | 4.9 |
| | | Clay | 1.8 |

TABLE 3-continued

| Example | | Components | Parts |
|---|---|---|---|
| | | PVA | 3.9 |
| | | Water | 2.5 |
| | 1-1 | Dispersion A-1 | 0.5 |
| | | Dispersion B-2 | 4.9 |
| | | Clay | 1.8 |
| | | PVA | 3.9 |
| | | Water | 2.5 |
| | 1-2 | Dispersion A-1 | 0.5 |
| | | Dispersion B-3 | 4.9 |
| | | Clay | 1.8 |
| | | PVA | 3.9 |
| | | Water | 2.5 |
| Control | 1-2 | Dispersion A-1 | 0.5 |
| | | Dispersion B-4 | 4.9 |
| | | Clay | 1.8 |
| | | PVA | 3.9 |
| | | Water | 2.5 |
| Control | 1-3 | Dispersion A-1 | 0.5 |
| | | Dispersion B-5 | 4.9 |
| | | Clay | 1.8 |
| | | PVA | 3.9 |
| | | Water | 2.5 |
| Control | 2 | Dispersion A-2 | 0.5 |
| | | Dispersion B-1 | 4.9 |
| | | Clay | 1.8 |
| | | PVA | 3.9 |
| | | Water | 3.4 |
| | 2-1 | Dispersion A-2 | 0.5 |
| | | Dispersion B-6 | 5.8 |
| | | Clay | 1.8 |
| | | PVA | 3.9 |
| | | Water | 2.5 |
| | 2-2 | Dispersion A-2 | 0.5 |
| | | Dispersion B-7 | 5.8 |
| | | Clay | 1.8 |
| | | PVA | 3.9 |
| | | Water | 2.5 |
| Control | 3 | Dispersion A-3 | 0.5 |
| | | Dispersion B-1 | 4.9 |
| | | Clay | 1.8 |
| | | PVA | 3.9 |
| | | Water | 2.5 |
| | 3-1 | Dispersion A-3 | 0.5 |
| | | Dispersion B-3 | 4.9 |
| | | Clay | 1.8 |
| | | PVA | 3.9 |
| | | Water | 2.5 |
| | 3-2 | Dispersion A-3 | 0.5 |
| | | Dispersion B-4 | 4.9 |
| | | Clay | 1.8 |
| | | PVA | 3.9 |
| | | Water | 2.5 |
| Control | 4 | Dispersion A-4 | 1.0 |
| | | Dispersion B-1 | 4.9 |
| | | Clay | 1.8 |
| | | PVA | 3.9 |
| | | Water | 2.0 |
| | 4 | Dispersion A-4 | 1.0 |
| | | Dispersion B-3 | 4.9 |
| | | Clay | 1.8 |
| | | PVA | 3.9 |
| | | Water | 2.0 |
| Control | 5 | Dispersion A-5 | 1.0 |
| | | Dispersion B-1 | 4.9 |
| | | Clay | 1.8 |
| | | PVA | 3.9 |
| | | Water | 2.0 |
| | 5 | Dispersion A-5 | 1.0 |
| | | Dispersion B-3 | 4.9 |
| | | Clay | 1.8 |
| | | PVA | 3.9 |
| | | Water | 2.0 |
| Control | 6 | Dispersion A-6 | 1.0 |
| | | Dispersion B-1 | 4.9 |
| | | Clay | 1.8 |
| | | PVA | 3.9 |
| | | Water | 3.4 |
| | 6-1 | Dispersion A-6 | 1.0 |
| | | Dispersion B-6 | 5.8 |
| | | Clay | 1.8 |
| | | PVA | 3.9 |

TABLE 3-continued

| Example | | Components | Parts |
|---|---|---|---|
| | | Water | 2.5 |
| | 6-2 | Dispersion A-6 | 1.0 |
| | | Dispersion B-7 | 5.8 |
| | | Clay | 1.8 |
| | | PVA | 3.9 |
| | | Water | 2.5 |
| Control | 7 | Dispersion A-7 | 1.4 |
| | | Dispersion B-1 | 4.9 |
| | | Clay | 1.8 |
| | | PVA | 3.9 |
| | | Water | 3.4 |
| | 7-1 | Dispersion A-7 | 1.4 |
| | | Dispersion B-6 | 5.8 |
| | | Clay | 1.8 |
| | | PVA | 3.9 |
| | | Water | 2.5 |
| | 7-2 | Dispersion A-7 | 1.4 |
| | | Dispersion B-7 | 5.8 |
| | | Clay | 1.8 |
| | | PVA | 3.9 |
| | | Water | 2.5 |
| Control | 8 | Dispersion A-1 | 0.6 |
| | | Dispersion B-1 | 4.9 |
| | | Dispersion C | 3.3 |
| | | Zinc stearate dispersion, 21% | 1.4 |
| | | PVA | 1.9 |
| | | Urea-formaldehyde resin pigment | 0.6 |
| | | Water | 4.3 |
| | 8-1 | Dispersion A-1 | 0.6 |
| | | Dispersion B-6 | 5.8 |
| | | Dispersion C | 3.3 |
| | | Zinc stearate dispersion, 21% | 1.4 |
| | | PVA | 1.9 |
| | | Urea-formaldehyde resin pigment | 0.6 |
| | | Water | 3.4 |
| | 8-2 | Dispersion A-1 | 0.6 |
| | | Dispersion B-7 | 5.8 |
| | | Dispersion C | 3.3 |
| | | Zinc stearate dispersion, 21% | 1.4 |
| | | PVA | 1.9 |
| | | Urea-formaldehyde resin pigment | 0.6 |
| | | Water | 3.4 |
| Control | 9 | Dispersion A-1 | 0.6 |
| | | Dispersion B-1 | 4.9 |
| | | Dispersion E | 1.0 |
| | | Zinc stearate dispersion, 21% | 1.4 |
| | | PVA | 1.9 |
| | | Micronized silica | 0.6 |
| | | Water | 4.3 |
| | 9 | Dispersion A-1 | 0.6 |
| | | Dispersion B-6 | 5.8 |
| | | Dispersion E | 1.0 |
| | | Zinc stearate dispersion, 20% | 1.4 |
| | | PVA | 1.9 |
| | | Micronized silica | 0.6 |
| | | Water | 3.4 |
| Control | 10 | Dispersion A-1 | 0.6 |
| | | Dispersion B-1 | 4.9 |
| | | Dispersion D | 2.0 |
| | | Zinc stearate dispersion, 21% | 1.4 |
| | | PVA | 1.9 |
| | | Micronized silica | 0.6 |
| | | Water | 4.3 |
| | 10 | Dispersion A-1 | 0.6 |
| | | Dispersion B-6 | 5.8 |
| | | Dispersion D | 2.0 |
| | | Zinc stearate dispersion, 21% | 1.4 |
| | | PVA | 1.9 |
| | | Micronized silica | 0.6 |
| | | Water | 3.4 |
| Control | 11 | Dispersion A-1 | 0.5 |
| | | Dispersion B-9 | 5.8 |
| | | PVA | 3.5 |
| | | Micronized silica | 1.0 |
| | | Water | 4.7 |
| | 11 | Dispersion A-1 | 0.5 |
| | | Dispersion B-8 | 5.8 |
| | | PVA | 3.5 |
| | | Micronized silica | 1.0 |

TABLE 3-continued

| Example | Components | Parts |
|---|---|---|
| | Water | 4.7 |

The thermally-sensitive record material sheets coated with one of the mixtures of Table 3 were imaged by contacting the coated sheet with a metallic imaging block at the indicated temperature for 5 seconds. The intensity of each image was measured by means of a reflectance reading using a Macbeth reflectance densitometer. A reading of 0 indicates no discernable image. The intensity of each image is a factor, among other things, of the nature and type of chromogenic compound employed. A value of about 0.9 or greater usually indicates good image development.The intensities of the images are presented in Table 4.

TABLE 4

| Example | Reflectance Density of Image Developed at Indicated Fahrenheit Temperature | | | | | | | | | | |
|---|---|---|---|---|---|---|---|---|---|---|---|
| | 300° | 275° | 260° | 245° | 230° | 215° | 200° | 185° | 170° | 155° | 140° |
| Control 1-1 | 1.17 | 0.90 | 0.67 | 0.42 | 0.16 | 0.08 | 0.03 | 0.03 | 0.03 | 0.03 | 0.03 |
| 1-1 | 1.18 | 1.18 | 1.15 | 0.84 | 0.24 | 0.10 | 0.03 | 0.01 | 0.01 | 0.01 | 0.01 |
| 1-2 | 1.12 | 1.16 | 1.18 | 1.19 | 0.76 | 0.17 | 0.07 | 0.01 | 0.01 | 0.01 | 0.01 |
| Control 1-2 | 1.10 | 1.09 | 0.78 | 0.62 | 0.31 | 0.18 | 0.06 | 0.04 | 0.04 | 0.04 | 0.04 |
| Control 1-3 | 0.83 | 0.95 | 0.96 | 0.99 | 0.94 | 0.54 | 0.19 | 0.07 | 0.03 | 0.03 | 0.03 |
| Control 2 | 1.35 | 1.33 | 1.31 | 1.22 | 1.05 | 0.69 | 0.34 | 0.15 | 0.07 | 0.07 | 0.07 |
| 2-1 | 1.42 | 1.42 | 1.39 | 1.32 | 0.97 | 0.49 | 0.18 | 0.10 | 0.05 | 0.05 | 0.05 |
| 2-2 | 1.37 | 1.38 | 1.39 | 1.37 | 1.32 | 1.09 | 0.70 | 0.27 | 0.11 | 0.09 | 0.09 |
| Control 3 | 1.10 | 0.91 | 0.77 | 0.69 | 0.52 | 0.40 | 0.20 | 0.06 | 0.05 | 0.05 | 0.05 |
| 3-1 | 0.94 | 1.03 | 1.04 | 0.94 | 0.69 | 0.29 | 0.11 | 0.02 | 0.02 | 0.02 | 0.02 |
| 3-2 | 0.87 | 1.00 | 1.04 | 1.02 | 0.83 | 0.38 | 0.16 | 0.02 | 0.02 | 0.02 | 0.02 |
| Control 4 | 0.79 | 0.27 | 0.05 | 0.03 | 0.03 | 0.03 | 0.03 | 0.03 | 0.03 | 0.03 | 0.03 |
| 4 | 0.99 | 0.91 | 0.57 | 0.13 | 0.04 | 0.02 | 0.02 | 0.02 | 0.02 | 0.02 | 0.02 |
| Control 5 | 0.77 | 0.21 | 0.05 | 0.03 | 0.03 | 0.03 | 0.03 | 0.03 | 0.03 | 0.03 | 0.03 |
| 5 | 0.86 | 0.77 | 0.32 | 0.12 | 0.03 | 0.02 | 0.02 | 0.02 | 0.02 | 0.02 | 0.02 |
| Control 6 | 0.86 | 0.28 | 0.11 | 0.05 | 0.04 | 0.04 | 0.04 | 0.04 | 0.04 | 0.04 | 0.04 |
| 6-1 | 0.96 | 0.80 | 0.46 | 0.26 | 0.02 | 0.02 | 0.02 | 0.02 | 0.02 | 0.02 | 0.02 |
| 6-2 | 0.71 | 0.62 | 0.57 | 0.50 | 0.35 | 0.05 | 0.03 | 0.03 | 0.03 | 0.03 | 0.03 |
| Control 7 | 1.30 | 0.80 | 0.37 | 0.17 | 0.07 | 0.02 | 0.02 | 0.02 | 0.02 | 0.02 | 0.02 |
| 7-1 | 1.39 | 1.38 | 1.14 | 0.81 | 0.10 | 0.03 | 0.03 | 0.03 | 0.03 | 0.03 | 0.03 |
| 7-2 | 1.18 | 1.13 | 1.05 | 1.02 | 0.89 | 0.36 | 0.02 | 0.02 | 0.02 | 0.02 | 0.02 |
| Control 11 | 1.23 | 1.01 | 0.35 | 0.12 | 0.04 | 0.02 | 0.02 | 0.02 | 0.02 | 0.02 | 0.02 |
| 11 | 1.04 | 1.09 | 1.11 | 1.13 | 1.08 | 0.69 | 0.10 | 0.02 | 0.02 | 0.02 | 0.02 |

The background coloration in some of the thermally-sensitive record material sheets was determined before calendering, after calendering and after aging the calendered sheets for three days. The intensity of the background coloration was measured by means of a reflectance reading using a Bausch & Lomb Opacimeter. A reading of 92 indicates no discernable color and the higher the value the less background coloration. The background data are entered in Table 5.

TABLE 5

| Example | Background Intensity | | |
|---|---|---|---|
| | Uncalendered | Calendered | Calendered, Aged 3 days |
| 1-1 | 89.0 | 88.6 | 87.1 |
| 1-2 | 89.1 | 89.0 | 87.8 |
| Control 1-2 | 87.1 | 84.3 | 82.3 |
| Control 1-3 | 88.4 | 87.5 | 85.3 |
| 8-1 | 89.6 | 88.5 | 87.5 |
| 8-2 | 89.5 | 88.5 | 87.7 |
| Control 8 | 87.5 | 84.4 | 76.6 |
| 9 | 89.9 | 88.0 | 85.6 |
| Control 9 | 88.8 | 83.2 | 78.5 |
| 10 | 89.8 | 88.2 | 86.3 |
| Control 10 | 88.7 | 84.6 | 80.2 |

From the data of Tables 4 and 5 it is readily apparent that thermally-responsive recording materials comprising the developer materials of the present invention produce substantially enhanced image intensities and/or enhanced thermal sensitivity and/or improved background coloration compared to corresponding thermally-responsive recording material comprising previously known developer material.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A thermally-responsive record material comprising a support member bearing a thermally-sensitive color-forming composition comprising chromogenic material and a bisphenol compound of the structure

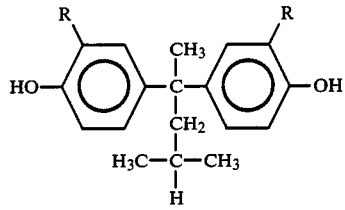

, wherein R is a 1–4 carbon alkyl radical, which produces a change in color of said chromogenic material by reacting with the chromogenic material when heated.

2. The record material of claim 1 in which the bisphenol is selected from the group consisting of 2,2-bis(4-hydroxy-3-methylphenyl)-4-methylpentane, 2,2-bis(4-hydroxy-3-isopropylphenyl)-4-methylpentane and 2,2-bis(4-hydroxy-3-tert.butylphenyl)-4-methylpentane.

3. The record material of claim 1 in which the chromogenic material is selected from the group consisting of 3-diethylamino-6-methyl-7-anilinofluoran; 7-(1-ethyl-2-methylindol-3-yl)-7-(4-diethylamino-2-ethoxyphenyl)-5,7-dihydrofuro[3,4-b]pyridin-5-one; 3-diethylamino-7-(2-chloroanilino)fluoran; 3-(N-methylcyclohexylamino)-6-methyl-7-anilinofluoran; 7-(1-octyl-2-methylindol-3yl)-7-(4-diethylamino-2-ethoxyphenyl)-5,7-dihydrofuro[3,4-b]pyridin-5-one; 3'-phenyl-7-dibenzylamino-2,2'-spirodi-[2H-1-benzopyran]; 3,3-bis(4-dimethylaminophenyl)-6-dimethylaminophthalide; 3-(2-hydroxy-4-diethylaminophenyl)-3-(2,4-dimethoxy-5-anilinophenyl)phthalide; 3-(2-hydroxy-4-diethylaminophenyl)-3-(2,4-dimethoxy-5-(4-choloroanilino)-phenyl)phthalide; and mixtures thereof.

4. The record material of claim 3 in which the chromogenic material is 3- diethylamino-6-methyl-7-anilinofluoran.

5. The record material of claim 1 or 4 which further comprises a binder selected from the group consisting of polyvinyl alcohol, methylcellulose, hydroxypropylmethylcellulose, starch, hydroxyethylcellulose, styrene-butadiene latex and mixtures thereof.

6. The record material of claim 5 in which the binder is selected from the group consisting of polyvinyl alcohol, methylcellulose, styrene-butadiene latex and mixtures thereof.

7. The record material of claim 6 in which the binder is a mixture of polyvinyl alcohol, methylcellulose and styrene-butadiene latex.

* * * * *